US005545470A

United States Patent [19]

Schuster et al.

[11] Patent Number: 5,545,470

[45] Date of Patent: Aug. 13, 1996

[54] ANTI-VANDALISM LAYER

[75] Inventors: Dieter H. P. Schuster; Achim G. Fels; Herbert Spors, all of Wuppertal, Germany

[73] Assignees: Akzo Nobel Faser AG; H.A. Schmitz GmbH, both of Wuppertal, Germany

[21] Appl. No.: 423,610

[22] Filed: Mar. 30, 1995

[30] Foreign Application Priority Data

Mar. 31, 1994 [DE] Germany ..... 44 11 346.3

[51] Int. Cl.[6] ..... D03D 3/00

[52] U.S. Cl. ..... 428/229; 428/225; 428/233; 428/253; 428/298; 428/344; 428/902; 428/257; 66/202

[58] Field of Search ..... 428/253, 297, 428/298, 233, 229, 256, 902, 344, 257; 5/448; 66/202

[56] References Cited

U.S. PATENT DOCUMENTS

| | | | |
|---|---|---|---|
| 4,143,197 | 3/1979 | Jasionowicz et al. | 28/225 |
| 4,384,449 | 5/1983 | Byrnes et al. | 57/210 |
| 4,470,251 | 9/1984 | Bettcher | 57/230 |
| 5,070,540 | 12/1991 | Bettcher et al. | 428/253 |
| 5,085,487 | 2/1992 | Weingartner et al. | 257/452 |
| 5,119,512 | 6/1992 | Donbar et al. | 428/225 |
| 5,275,769 | 1/1994 | Clements | 264/46.4 |
| 5,283,918 | 2/1994 | Weingartner et al. | 5/481 |
| 5,356,701 | 10/1994 | Wei et al. | 428/253 |
| 5,385,774 | 1/1995 | Cramer et al. | 428/247 |

FOREIGN PATENT DOCUMENTS

| | | |
|---|---|---|
| 52272 | 8/1986 | Australia . |
| 190064 | 8/1986 | European Pat. Off. . |
| 512382 | 2/1988 | European Pat. Off. . |
| 190064 | 10/1988 | European Pat. Off. . |
| 0355879 | 2/1990 | European Pat. Off. . |
| 512382 | 11/1992 | European Pat. Off. . |
| 0569849 | 11/1993 | European Pat. Off. . |
| 2573969 | 6/1986 | France . |
| 2592334 | 7/1987 | France . |
| 8337573 | 4/1984 | Germany . |
| 3508333 | 9/1986 | Germany . |
| 3702639 | 2/1987 | Germany . |
| 3711837 | 6/1987 | Germany . |
| 3545071 | 6/1987 | Germany . |
| 3702639 | 7/1987 | Germany . |
| 3711837 | 2/1988 | Germany . |
| 3711419 | 10/1988 | Germany . |
| 8790033 | 7/1989 | Germany . |
| 9004625 | 8/1990 | Germany . |
| 9206365 | 9/1992 | Germany . |
| 9217352 | 5/1993 | Germany . |
| 9317798 | 4/1994 | Germany . |
| 4401417 | 4/1994 | Germany . |
| 4241973 | 6/1994 | Germany . |
| 4401417 | 7/1994 | Germany . |
| 2204235 | 11/1988 | United Kingdom . |
| WO91/11122 | 8/1991 | WIPO . |

OTHER PUBLICATIONS

Wilken, C., "Geraschelte Abstandsgewirke", *Melliand Textilberichte* (1993) vol. 7, pp. 993–997.

Worldwide Textiles English Abstract of "Geraschelte Abstandsgewirke" article.

*Primary Examiner*—James J. Bell

*Attorney, Agent, or Firm*—Joseph M. Noto; Louis A. Morris

[57] ABSTRACT

An anti-vandalism layer, especially for application in vehicle seats, vehicle roofs, vehicle tarpaulins, tents, inflatable structures, wall facing, and similar objects having an incisible exterior layer and subject to vandalism, includes of a knit fabric having at least in part cut-resistant fibers such as aromatic polyamide fibers, gel-spun polyethylene fibers, or glass fibers is disclosed. In at least one thread system, the knit fabric contains a wire present in a thread system projecting from the surface of the knit fabric such that during subsequent gluing of the anti-vandalism layer to, for example, a textile flat structure, gluing tends to occur on this thread system.

21 Claims, 3 Drawing Sheets

ANTI-VANDALISM LAYER

CROSS REFERENCE TO RELATED APPLICATIONS

This application claims the benefit of the filing date of prior German Patent Application Number P 44 11 346.3, filed Mar. 31, 1994, which is incorporated herein by reference in its entirety.

BACKGROUND OF THE INVENTION

1. Field of the Invention

The present invention relates to an anti-vandalism layer. In particular, the present invention relates to an anti-vandalism layer for vehicle seats, vehicle roofs, vehicle tarpaulins, tents, inflatable structures, wall facing, and similar objects having an incisible exterior layer and subject to vandalism.

2. Description of the Related Art

Particularly in public transportation vehicles such as trains, busses, and the like, vandalism in the form of damage to seat coverings, especially by ripping the coverings to shreds, is ever on the rise. For this reason, operators of public transportation are increasingly forced to guard against this vandalism when outfitting new vehicles or when replacing damaged seats. The interest in cut-resistant seat fabrics has therefore increased significantly from the recent past.

Not only vehicle seats are endangered by vandalism, however. Increasing vandalism, often coupled with the intent to steal, has also been observed on sliding vehicle roofs and convertible tops; tarpaulins on trucks or other commercial transport vehicles; tents, inflatable structures, and other objects in textile construction; and wall facing such as impact pads in sports facilities or public transportation.

In order to prevent or at least hamper vandalism, several different solutions to the problem have been proposed.

For example, DE-A 3 702 639 suggests the use of a fine-mesh metal woven fabric between the exterior material of the seat covering and the foam serving as the body of the seat. A similar approach is proposed in GB-A 2 204 235.

Knit structures made from wire or metal fibers are described in DE-U 90 04 625 and EP-A 190 064. A protective layer made from metal rings is described by DE-A 3 711 419.

Flat structures made from metal wires or metal fibers have serious disadvantages for vandalism protection, however, especially in the case of vehicle seats. These disadvantages are seen during seat manufacture and particularly when the seat is used. These anti-vandalism layers are normally located under the seat covering itself, since only here can they exercise their protective action without attracting the attention of the occupant or the vandal.

Such metal-wire or metal-fiber flat structures are relatively difficult to work due to their limited flexibility, since additional cutting or scissoring steps are needed especially to cover uneven surfaces, something required to a great extent in the manufacture of vehicle seats and exerting a negative effect on production costs.

The disadvantages of metal-wire or metal-fiber anti-vandalism layers are especially noticeable when the seat is in use. Such anti-vandalism layers considerably impair sitting comfort because the inserts result in a harder and thus less comfortable sitting surface.

Moreover, the repeated separation of individual broken wires during use represents a significant problem. These wires pierce the actual seat covering and project from the surface in a way that their presence is often not apparent. This can result in injuries with very serious consequences to users of public transportation. When metal-wire or metal-fiber anti-vandalism layers are employed, operators of public transportation even speak of an increased risk of AIDS infection. For this reason, public transportation operators have a great interest in replacing these anti-vandalism layers with more suitable materials.

For this reason, anti-vandalism layers made from cut-resistant textile fibers have also been described. For example, AU-A 86-52 272 proposes constructing the anti-vandalism layer from a woven fabric or a needle felt made from aramid fibers and gluing this layer to the exterior material. EP-A 355 879 also mentions a needle felt made from aramid fibers as an anti-vandalism layer. FR-A 2 573 969 merely cites aramid fibers, without any information as to what types of flat structures are involved.

Neither woven fabrics nor needle felts made from aramid fibers, however, exhibit the required cut and puncture resistance in corresponding trials. While these approaches avoid the disadvantages of metal anti-vandalism layers, they do not sufficiently meet the requirements for anti-vandalism layers with respect to cut and puncture resistance.

Two anti-vandalism layers, one made from a metal screen and a second from aramid fibers, are described in FR-A 2 592 334. In this case, the aforementioned disadvantages are somewhat reduced, but there is still the risk of injury due to protruding wires, and the disadvantage that metal anti-vandalism layers cannot be as readily worked. Furthermore, this approach results in higher production costs than for a uniform anti-vandalism layer.

A protective layer, which can comprise various flat structures and a wide variety of materials such as glass-, polyester-, ceramic- , aramid-, or carbon fibers is mentioned in EP-A 512 382. These fiber materials can take the form of screens, nets, woven fabrics, or knits. This patent application, however, does not teach how such a protective layer would be constructed in order to adequately resist vandalism.

A protective layer in the form of a knit structure is described in DE-A 42 08 600. The fiber material is preferably a blend of preoxidized polyacrylonitrile fibers and aramid fibers. Since this knit construction results in too many rigid connections such as drawn warp and weft threads, the cut resistance of such a protective layers is inadequate. Although the aforementioned approaches describe special protective layers located under the actual seating layer, DE-C 37 11 837 concerns itself with the design of a seat covering with vandalism-impeding characteristics. Here, a fabric is proposed in which a portion of the warp and weft threads are made from stranded wire with a sheath of laced textile yarn. The sheath can apparently be moved with respect to the core. Such a construction does not meet the requirements for a vandalism-inhibiting material, since it fails to offer sufficient protection against incision with a knife, due to the inflexible wires. Moreover, the ability to work a covering material is impaired by the stranded wire. Finally, such a seat covering can be manufactured only at high cost.

DE-C 35 45 071 proposes a fire-protection layer made from elastic material, treated for flame retardation, in conjunction with a wire, and this layer can simultaneously protect against cutting. Here, a wire is incorporated in a woven or knit fabric, but there is no teaching concerning the type of wire, the construction of the flat structure, or the fiber material. The inclusion of wire is in itself not sufficient to provide adequate cut resistance and in particular to avoid the risk of injury caused by the wire. Since the proposed companion fibers are elastic yarns made from any type of raw material, the required cut resistance is not attainable with such an anti-vandalism layer embodiment. Furthermore, in the anti-vandalism layer proposed in this case, as well as in other proposals involving wire, protrusion of the wire cannot be adequately prevented. Additional disadvantages of the fire-protection layer proposed here are the insufficient cut resistance resulting from the described short laps and the proposed rigid attachment to the exterior material, as well as the inadequate flexibility offered by the proposed stationary thread technique. The varied requirements for an anti-vandalism layer cannot be met with the described construction.

While numerous products have been proposed for reducing damage to public-transportation vehicle seats by vandalism, the problem of vandalism, usually coupled with the intent to steal, has received little attention in the case of other products such as tarpaulins for trucks, tents, and the like. A textile fabric impeding vandalism and especially developed for use in truck tarpaulins, tents, inflatable structures, and the like, is described in German patent application P 43 40 483.9.

An anti-vandalism flat structure especially suited for convertible tops but also for other objects subject to vandalism is proposed by DE-A 42 15 662. It consists of a composite material comprising at least two layers, of which at least one comprises yarns made from aramid fibers, that can apparently be pushed together using little force.

Likewise, a material for foldable vehicle tops with an exterior material made from a coated polyester woven fabric and a reinforcement layer in the form of a woven screen fabric or thread composite made from glass-, carbon-, or metal fibers, for example, is described in DE-U 92 06 365.

Finally, DE-U 92 17 352 describes a bellows with a cut-resistant insert layer of metal wires or high-strength synthetic fibers.

All of the previously cited approaches have considerable drawbacks with respect to workability, risk of injury, and manufacturing costs. For the most part, they also do not offer the desired cut resistance for sufficient protection against vandalism.

SUMMARY OF THE INVENTION

In accordance with one aspect of the present invention, there is provided an anti-vandalism layer that eliminates the disadvantages of previous constructions and materials in the art, such as unsatisfactory workability, low puncture and cut resistance, risk of injury, and the like, and that furthermore permits cost-effective manufacture and working.

In accordance with another aspect of the present invention, there is provided an anti-vandalism layer exhibiting flame-resistance or non-flammability characteristics, to respond to the demands of public-transportation operators for flame resistance in the anti-vandalism layer.

It has surprisingly been discovered that these and other aspects can be met in a particularly advantageous manner when an anti-vandalism layer in accordance with the present invention is used.

Moreover, these and other aspects of the present invention will become apparent upon a review of the following detailed description and the claims appended thereto.

DETAILED DESCRIPTION OF PREFERRED EMBODIMENTS

The anti-vandalism layer of the present invention includes a knit fabric that has been made at least in part from cut-resistant fibers such as aramid fibers, gel-spun polyethylene fibers, or glass fibers. At least one thread system of this knit fabric contains a wire. This wire is present in at least one thread system projecting from the surface of the knit fabric in such a way that subsequent gluing of the anti-vandalism layer tends to occur on this thread system.

Aramid fibers are particularly suitable as cut-resistant textile fibers for making anti-vandalism layers. These fibers, frequently also referred to as aromatic polyamide fibers, are commercially available under trade names such as Twaron{SYMBOL 210 \f "Symbol"}. Besides good cut resistance, another significant advantage of aramid fibers is their low flammability, avoiding the need for a special treatment with flame-retarding substances when using this type of fiber. The desire for low flammability is particularly prevalent in the case of vehicle seats for public transportation. Furthermore, aramid fibers have very high strength characteristics.

Polyolefin fibers, in particular gel-spun polyethylene fibers, can be used in place of aramid fibers in making the anti-vandalism layer. In contrast to aramid fibers, however, they lack the advantage of low flammability and are thus not suitable in applications such as vehicle seats for public transportation, where this characteristic is needed.

Glass fibers, which like the aramid fibers offer a good solution with respect to flammability, can be used in manufacturing the anti-vandalism layer of the present invention.

Aramid fibers, gel-spun polyethylene fibers, and glass fibers can be employed in the anti-vandalism layer either alone, as blends among themselves, or as blends with other fibers. In selecting the companion fibers for a blend and the blend ratio, the cut-resistance properties and low flammability must not be impaired. The sole use of one cut-resistant fiber as a textile component in the anti-vandalism layer is preferred. Especially preferred is the sole use of aramid fibers as cut-resistant textile fibers in the anti-vandalism layer.

The yarn titers desirable for producing the anti-vandalism layer of the present invention are between 420 and 8,500 dtex. The range from 1,000 to 5,000 dtex is preferred, and the range from 1,500 to 3,500 dtex is especially preferred. In selecting the yarn titer, a middle course is taken between the desired cut resistance and comfort during use. Higher titers offer better cut resistance than lower ones, but lower titers are preferred where sitting comfort is concerned. The filament titer of these yarns is preferably be less than 5 dtex, and a titer range of 0.5 to 3 dtex is most preferred.

For the manufacture of the vandalism-protective layer of the present invention, a knit fabric is employed, preferably a warp knit fabric, with special preference given to knit fabrics produced on Raschel or crochet galloon machines and commonly referred to as Raschel or crochet galloon fabrics. The weight per unit area of this fabric can range from 100 to 2,000 g/m$^2$. A sufficient cut resistance is not possible under 100 g/m$^2$. The range from 200 to 1,000 g/m$^2$ is preferred, and the range from 200 to 600 g/m$^2$ is especially preferred. Trials have shown that in particular the cut resistance required for public transportation is generally readily attainable in the range from 300 to 400 g/m$^2$. Since the cut resistance depends on several other properties such as yarn titer, however, the range from 300 to 400 g/m$^2$ can be adjusted upward or downward depending on the type of yarn used. Higher ranges of 500 to 700 g/m$^2$ and especially of 700 to 1,000 g/m$^2$ can significantly improve the cut resistance but for economic reasons cannot always be attained.

With respect to the mesh density, values between 1/cm and 20/cm have proven favorable. The range from 2/cm to 5/cm, within which the desired cut resistance can be achieved, is especially preferred.

Compared to the predominantly woven prior art fabrics proposed up to now for manufacturing anti-vandalism layers, knit fabrics, especially those produced on Raschel or crochet galloon machines, offer significant advantages, which are manifested in cut resistance and workability characteristics.

Crochet galloon machines are especially suited to manufacturing the anti-vandalism layer of the present invention. Raschel machines can also be used if a conversion is performed to enable long laps. Both types of machines are well known by these names in knit fabric production.

In a cutting trial with a knife, the cutting instrument in the case of woven fabrics tends to act perpendicular to the yarn of the anti-vandalism layer. Due to their construction, this is not the case with knit fabrics. Perpendicular action when applying the knife in this case is rare. The force component of the yarn that opposes in parallel the action of the cutting instrument is therefore significantly lower for woven fabrics than for knit fabrics, resulting in a special advantage of knit fabrics over wovens. As cutting trials have indicated, knit fabrics permit significantly higher cut resistance than woven fabrics or the needle felts also proposed for anti-vandalism layers.

Additional significant advantages are seen in the workability properties of knit fabrics as compared to woven fabrics. It is known that considerable losses in strength must be accepted in the manufacture of woven fabrics from aramid fibers, amounting to as much as 50% of the initial strength in the case of improper workmanship. This strength impairment occurring in woven-fabric production is in all probability attributable to the quetch and shear stresses on the yarns at the intersections of the warp and weft threads. Due to the processing technique and the construction of knit fabrics, these stresses are considerably lower in this case. Retention of initial aramid-fiber strength is thus significantly better in the manufacture of knit fabrics as compared to woven fabrics.

A further advantage of the knit fabric over wovens or needle felts is its flexibility when being worked. This advantage is particularly evident in the manufacture of seat coverings, considering their normally contoured surfaces.

The wire used in the anti-vandalism layer can be a solid wire, a wire yarn, or a wire twist. The diameter of this wire should be between 0.1 and 2.0 mm; the range 0.2 to 0.6 mm is preferred.

The percentage by weight of the wire in the knit fabric depends on a number of factors. For example, the percentage can be relatively low if two or more anti-vandalism layers are superimposed. On the other hand, a higher percentage is required when, for example, the knit fabric is not manufactured solely from cut-resistant fibers but rather from blends of cut-resistant and non-cut-resistant fibers. Therefore, the percentage by weight of the wire in the anti-vandalism layer of the present invention can range from 10 to 90%. The range 20 to 60% is preferred.

The wire should have a corrugated or spiral shape. In the interest of improved workability, a corrugated shape is preferred. This corrugation offers three important advantages.

First, the cut resistance of an anti-vandalism layer made with a corrugated wire is considerably higher than one with a straight wire. The superior cut resistance of fabric made with corrugated wire is mainly attributable to the fact that a corrugated wire in the anti-vandalism layer has a greater surface area than a straight wire. When inserting a knife, and especially when attempting to draw it through the fabric involved, the probability that the knife will encounter the wire and be unable to proceed is significantly higher with a corrugated wire than with a straight one. The advantage of the corrugated wire is especially evident when the knit fabric is made from blends of cut-resistant and non-cut-resistant fibers.

Another advantage of the corrugated wire compared to the straight wire is the lower risk of separation from the composite of the anti-vandalism layer and of consequent injury. Due to its shape, the probability is significantly lower, in comparison to a straight, uncorrugated wire, that the corrugated wire will be forced upward and protrude from the exterior material when subjected to the mechanical stresses during seat use.

A third advantage of using a corrugated wire is the improved flexibility of the knit fabric produced and the resulting improvement in workability.

There are no special restrictions with respect to the shape or number of corrugations. A length ratio of 1:1.5 to 1:3.5 has proven advantageous. In the length ratios cited here, 1 is the length of the wire in the corrugated or spiral state, and the second number is the length of the wire after extension and drawing out of the structure.

Preferably, the wire used in the anti-vandalism layer of the invention is sheathed in textile fibers. Possibilities in this case are covering by spinning, wrapping, or twisting in. These methods are known to those skilled in the art. The use of a knit-sheathed wire in manufacturing the anti-vandalism layer of the present invention is especially preferred.

Knit sheathing results when the wire is introduced into the knit fabric and the sheath is formed by additional knitting stitches, such that a knit structure is formed to enclose the wire. If the wire is separated, this knit sheathing prevents the wire from working its way out of the anti-vandalism layer, due to the mechanical stresses on the anti-vandalism layer, and causing injury as a result.

Trials have shown that, due to the special structure of the sheathing layer, knit sheathing permits considerably greater protection of the wire against protrusion than other sheathing methods such as covering by spinning, wrapping, or twisting in.

Knit sheathing of the wire can employ yarns of any desired fiber material. However, in the interest of optimum cut resistance of the anti-vandalism layer, it is preferable to use a cut-resistant fiber such as an aramid fiber, a gel-spun polyethylene fiber, or a glass fiber. Use of an aramid fiber is especially preferred.

The wire used in making the anti-vandalism layer of the invention can be enveloped in a readily fusible polymer. All polymers applicable as hot-melt adhesives are suitable. Examples of such polymers are ethylene/vinyl acetate copolymers, copolyamides, copolyesters, polyisobutylene, and polyvinylbutyrals.

A wire enveloped in hot-melt adhesive is preferably introduced during manufacture of the knit fabric into the thread system intended specifically for gluing. The anti-vandalism layer of the present invention can thus contain wire enveloped in hot-melt adhesive as well as wire without a hot-melt-adhesive covering.

The present invention, however, is not restricted to the use of wire enveloped in hot-melt adhesive. Gluing to other layers can also be performed using conventional adhesive-application means. It is important in this case, however, for at least one thread system projecting from the surface of the knit fabric to contain a wire and for gluing to favor this thread system. To this end, for example, weft threads are inserted with a figuring guide bar between the knit threads, such as aramid-fiber yarns, threaded with a short guide bar. Additional weft threads containing a knit-sheathed wire are then threaded over the first ones using a second figuring guide bar. These wire-containing threads project from the surface of the knit fabric.

Another possibility is to work with three figuring guide bars and use an aramid-fiber yarn for the first of these figuring guide bars and a knit-sheathed wire for the lap over it using a second figuring guide bar. In addition, another knit-sheathed wire is threaded over the knit threads using a third figuring guide bar.

A preferred structure of the knit fabric is one containing the wire in the long laps, since this is the preferred way to attain good cut resistance.

Figure 1:
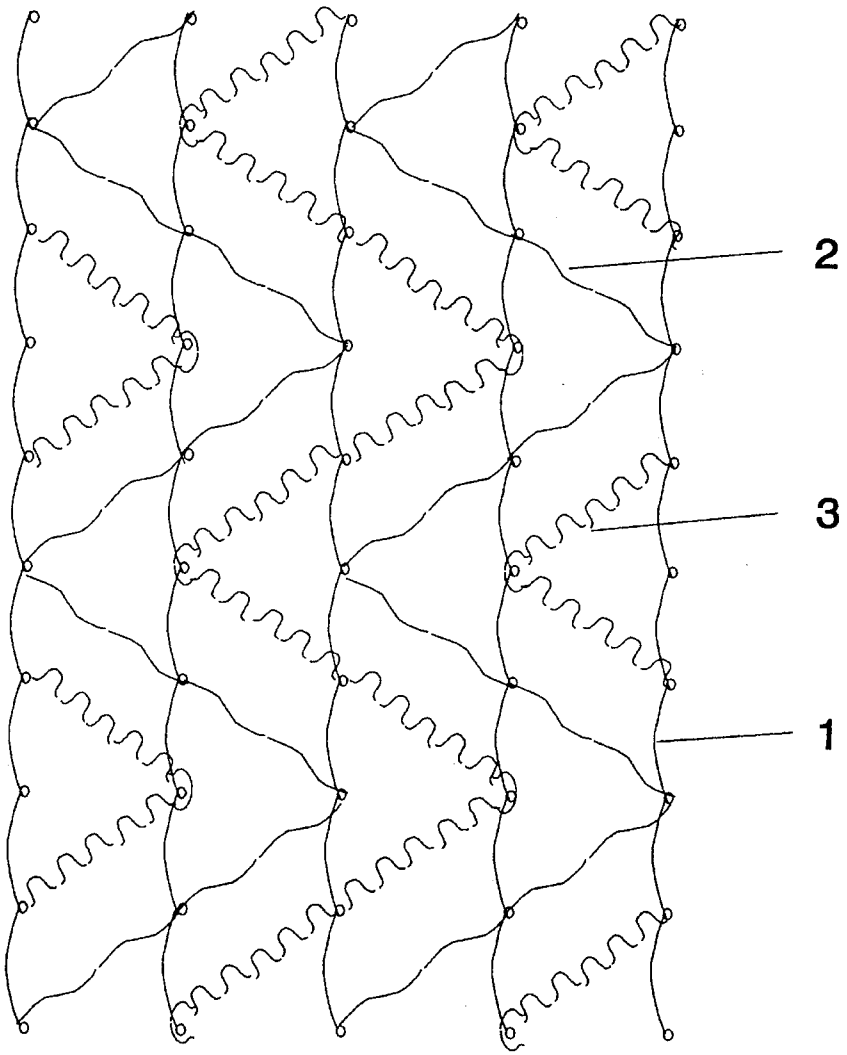
FIG. 1 shows an example of a crochet galloon fabric with a lap of knit-sheathed wire produced using a figuring guide bar. Using a first figuring guide bar, a figure lap 2 of aramid yarns is performed over lap 1 of aramid yarns produced using a short guide bar, followed on top by a figure lap 3 of wire, knit-sheathed in aramid yarn, using an additional figuring guide bar.

The knit-fabric structures illustrated here are only examples and are not to be considered restrictive.

During adhesive application, for example using an applicator roller, an adhesive film tends to form on the wire-containing threads projecting from the surface of the knit fabric, and adhesion to the adjacent layer occurs especially at these locations. In this manner, a linewise gluing pattern is achieved, which ensures sufficient flexibility of the adjacent layer glued to the anti-vandalism layer. This flexibility is especially important for good cut resistance.

If double-sided gluing is desired, the lap using the short guide bar, for example, can also comprise a knit-sheathed wire.

The decision as to which thread systems contain a knit-sheathed wire depends primarily on the intended application and the required cut-resistance characteristics.

The anti-vandalism layer of the invention is employed primarily in vehicle seats for public transportation. This protective layer is covered with an exterior material, for which any desired type of vehicle seat covering material is suitable. There are no restrictions concerning the fiber type or the construction of the textile flat structure for the exterior material. The exterior material selected should be treated for flame retardation or be made from a fiber in which a flame-retardant substance was incorporated during spinning. A pile material is especially suited as the exterior material. If an attempt is made to slit open the vehicle seat, the knife will first encounter resistance in the underlying anti-vandalism layer. Depending on the attachment of the exterior material to the anti-vandalism layer, therefore, a short incision can occur in the exterior material. When using a pile woven fabric or a pile knit fabric as the exterior material, it is possible that the incision will be covered by partial displacement of the pile when the seat is again occupied and be inconspicuous. With a flat woven fabric or a flat knit fabric as the exterior material, the incision will be more noticeable.

Especially when using the anti-vandalism layer in vehicle seats, the type of gluing assumes significant importance. Full-surface gluing to the exterior material is a disadvantage in this case. In the interest of good cut resistance, a certain mobility of the knit fabric located under the exterior material as an anti-vandalism layer is desirable, since the penetration resistance is greater in this case than with an anti-vandalism layer glued to the exterior material rigidly or over the entire surface. Using the knit-fabric structure of the present invention, which exhibits a thread layer projecting from the surface of the knit fabric and to which the selected adhesive tends to be applied, a linewise gluing pattern can be achieved without additional expense, for example when the adhesive is applied with a roller. Since the present invention specifies that this thread layer projecting from the surface of the knit fabric contain a wire, gluing will tend to occur on the wire-containing thread system. As corresponding trials have shown, better adhesion is attained at the wire-containing locations than at those not containing wire. With the construction of the present invention, this adhesive effect is adequate, even when gluing is linewise. On the other hand, linewise gluing also offers the advantage of good separability when, for example, repair of the vehicle seat, such as replacement of the exterior material, is required.

The vehicle seat generally has an upholstery foam beneath the anti-vandalism layer. The foam employed is preferably polyurethane foam. To satisfy the low-flammability requirements generally applying to vehicle seats for public transportation, it is practical to add a flame-retarding substance to the foam.

In the same manner as for the sitting surface of vehicle seats, the anti-vandalism layer of the invention can also be used for arm- and backrests of vehicle seats in public transportation.

The application of the anti-vandalism layer of the invention, however, is not intended to be limited to vehicle seats for public transportation. Numerous additional applications are possible. Examples are vehicle tarpaulins, sliding roofs and convertible tops, wall facings such as impact pads, tents, and inflatable structures. This list is intended only to cite examples and is not to be regarded as restrictive. The anti-vandalism layer of the present invention can be advantageously used wherever the risk exists that the exterior layer fabrics, usually textile flat structures or plastics, will be slit open as a result of vandalism or the intent to steal.

The present invention is also not to be seen as restricted to the use of only one anti-vandalism layer in the cited or other related articles. In the same manner, two or more anti-vandalism layers can be used.

The anti-vandalism layer described can also find application as a protective layer in articles that are not endangered by vandalism, however. For example, the anti-vandalism layer of the present invention, preferably made from aramid fibers, can be used to particular advantage in splinter-protection walls, such as on airports. Due to the very good antiballistic properties of the aromatic polyamide fibers, the anti-vandalism layer of the invention also offers good protection against splinters. In this case, it is practical to use multiple anti-vandalism layers.

The anti-vandalism layer of the present invention provides effective protection against being slit open. Furthermore, the anti-vandalism layer of the present invention offers a number of additional advantages such as low injury risk when the wire inserts break and good separability of the anti-vandalism layer from the adjacent layer when repairs are necessary, but also good adhesion to the adjacent layers. In public transportation, use of aramid fibers or glass fibers offers the special advantage that the anti-vandalism layer has low flammability.

The invention will be further illustrated with reference to the following specific examples. It is understood that these examples are given by way of illustration and are not meant to limit the disclosure or the claims to follow.

EXAMPLE 1

A knit fabric constructed in accordance with the present invention as shown in FIG. 1 was produced on a crochet galloon machine. An aramid filament yarn with a titer of 840 dtex was used for the lap using a short guide bar. A figure lap of an aramid filament yarn with a titer of 1,680 dtex was inserted using a first figuring guide bar. Above that, a lap of a knit-sheathed wire was performed using a second figuring guide bar. The wire had a diameter of 0.3 mm and was knit-sheathed in an aramid filament yarn with a titer of 840 dtex.

A knit fabric with a weight per unit area of 286 g/m$^2$ was obtained. The cutting trial was conducted with both a pocket knife and a double-edged dagger. Although penetration was possible in each case, the cutting instrument could not be drawn further.

The knit fabric so produced was applied experimentally as an anti-vandalism layer in a vehicle seat, with pointwise gluing of the anti-vandalism layer to the exterior material. The results of the cutting trial on the anti-vandalism layer were confirmed. Penetration was possible, but the knife could not be drawn further. The relatively small area of damage to the exterior material, as well as the adhesive between the anti-vandalism layer of the exterior material, prevented any possibility of reaching under the exterior material with the hand and thereby causing additional damage to the vehicle seat.

EXAMPLES 2 TO 4

Knit fabrics were constructed in a manner analogous to the construction described in Example 1 and FIG. 1, wherein the yarn titer and wire thickness were varied as indicated in the following table. The table contains the resultant weight per unit area data.

| | Example 2 | Example 3 | Example 4 |
|---|---|---|---|
| Short guide bar Aramid yarn Titer (dtex) | 1,100 | 1,680 | 1,680 |
| Figuring guide bar 1 Aramid yarn Titer (dtex) | 1,680 | 3,360 | 3,360 |
| Figuring guide bar 2 | | | |
| Wire (mm) | 0.6 | 0.3 | 0.6 |
| Aramid yarn for knit sheathing Titer (dtex) | 840 | 1,680 | 1,680 |
| Weight per unit area (g/m$^2$) | 765 | 415 | 885 |

For the knit fabrics produced for Examples 2 to 4, the cutting trial was conducted in the same manner as for the anti-vandalism layer of Example 1. The same results were obtained. Both cutting instruments were able to penetrate the material, but they could not be drawn further.

EXAMPLE 5

Figure 2:
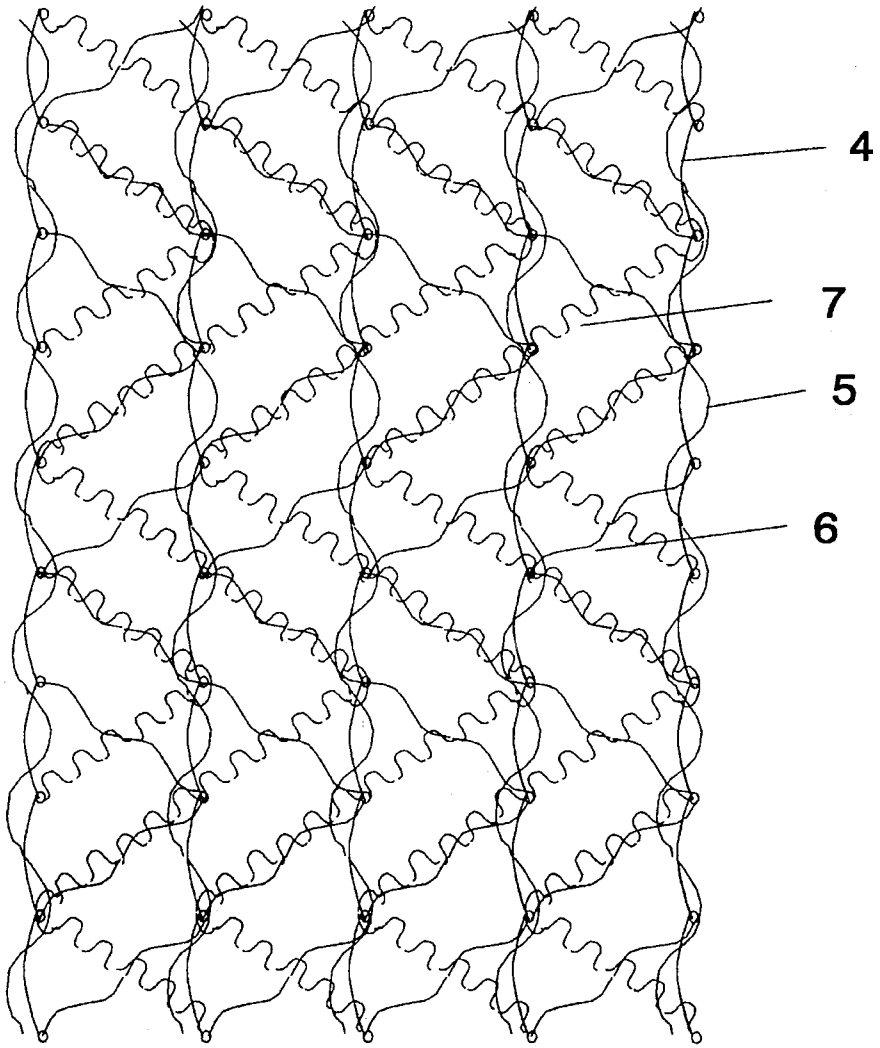
FIG. 2 shows another example, in which lap 4 is formed with a short guide bar, again using aramid yarns. Figure laps 5 and 6 produced with figuring guide bars consist also of aramid yarns. Additionally, a figure lap 7 of wire, knit-sheathed in aramid fiber, has been inserted in the knit fabric using another figuring guide bar.

A knit fabric constructed in accordance with the present invention as shown in FIG. 2 was produced on a crochet galloon machine. An aramid filament yarn with a titer of 840 dtex was used for the lap using a short guide bar. A figure lap of an aramid filament yarn with a titer of 1,680 dtex was introduced using a first figuring guide bar. Above that, a lap of an aramid filament yarn with a titer of 1,680 dtex was performed using a second figuring guide bar. Finally, an additional figure lap of a knit-sheathed wire was provided using a third figuring guide bar. The wire had a diameter of 0.3 mm and was knit-sheathed in an aramid filament yarn with a titer of 840 dtex.

A knit fabric with a weight per unit area of 332 g/m$^2$ was obtained. The cutting trial was conducted with a pocket knife and a double-edged dagger, as in Example 1. Penetration was possible in each case, but the cutting instrument could not be drawn further.

EXAMPLES 6 TO 8

Knit fabrics were constructed in a manner analogous to the construction described in Example 5 and FIG. 2, wherein the yarn titer and wire thickness were varied as indicated in the following table. The table contains the resultant weight per unit area data.

| | Example 6 | Example 7 | Example 8 |
|---|---|---|---|
| Short guide bar Aramid yarn Titer (dtex) | 1,100 | 1,680 | 1,680 |
| Figuring guide bar 1 Aramid yarn Titer (dtex) | 1,680 | 3,360 | 3,360 |
| Figuring guide bar 2 Aramid yarn Titer (dtex) | 3,360 | 3,360 | 3,360 |
| Figuring guide bar 3 | | | |
| Wire (mm) | 0.3 | 0.3 | 0.6 |
| Aramid yarn for knit sheathing Titer (dtex) | 1,680 | 1,680 | 1,680 |
| Weight per unit area (g/m$^2$) | 471 | 506 | 977 |

For the knit fabrics produced for Examples 6–8, the cutting trial was conducted in the same manner as for the anti-vandalism layer of Example 1. The same results were obtained. Both cutting instruments were able to penetrate the material, but they could not be drawn further.

EXAMPLE 9

Figure 3:
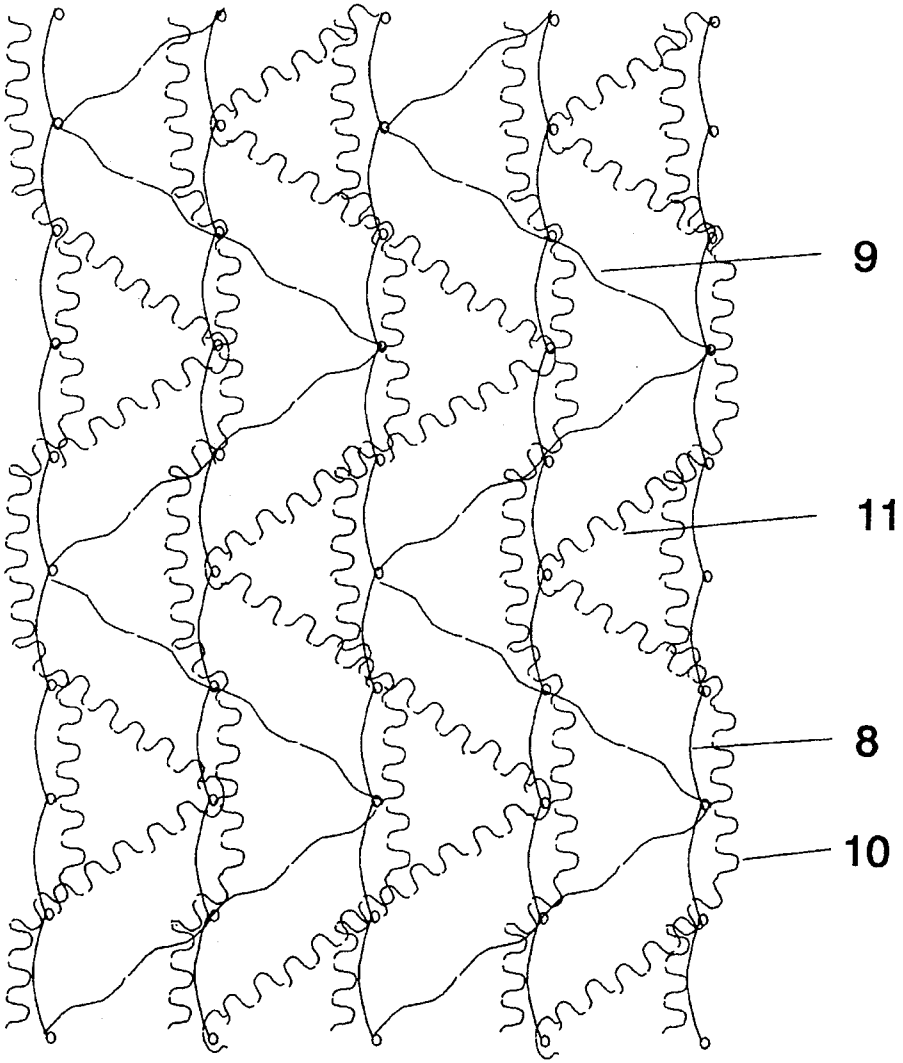
FIG. 3 shows an example with two wire-containing laps. Lap 8 using a short guide bar and figure lap 9 performed with a first figuring guide bar comprise aramid yarns. Figure laps 10 and 11 produced using two additional figuring guide bars contain the wire, knit-sheathed in aramid yarns.

A knit fabric constructed in accordance with the present invention as shown in FIG. 3 was produced on a crochet galloon machine. An aramid filament yarn with a titer of 840 dtex was used for the lap using a short guide bar. A figure lap of an aramid filament yarn with a titer of 1,680 dtex was inserted using a first figuring guide bar. Above that, a lap of a knit-sheathed wire was performed using a second figuring guide bar. The wire had a diameter of 0.3 mm and was knit-sheathed in an aramid filament yarn with a titer of 840 dtex. Finally, an additional figure lap of a knit-sheathed wire was produced using a third figuring guide bar. The wire had a diameter of 0.3 mm and was knit-sheathed in an aramid filament yarn with a titer of 840 dtex.

A knit fabric with a weight per unit area of 386 g/m$^2$ was obtained. The cutting trial was conducted with a pocket knife and a double-edged dagger, as in Example 1. Penetration was possible in each case, but the cutting instrument could not be drawn further.

EXAMPLES 10 AND 11

Knit fabrics were constructed in a manner analogous to the construction described in Example 9 and FIG. 3, wherein the yarn titer and wire thickness were varied as indicated in the following table. The table contains the resulting weight per unit area data.

| | Example 10 | Example 11 |
|---|---|---|
| Short guide bar Aramid yarn Titer (dtex) | 1,100 | 1,680 |
| Figuring guide bar 1 Aramid yarn Titer (dtex) | 1,680 | 3,360 |
| Figuring guide bar 2 | | |
| Wire (mm) | 0.3 | 0.3 |
| Aramid yarn Titer (dtex) | 1,100 | 1,680 |
| Figuring guide bar 3 | | |
| Wire (mm) | 0.6 | 0.3 |
| Aramid yarn for knit sheathing Titer (dtex) | 840 | 1,680 |
| Weight per unit area (g/m$^2$) | 877 | 554 |

For the knit fabrics produced for Examples 10 and 11, the cutting trial was conducted in the same manner as for the anti-vandalism layer of Example 1. The same results were obtained. Both cutting instruments were able to penetrate the material, but they could not be drawn further.

While the invention has been described with preferred embodiments, it is to be understood that variations and modifications are to be considered within the preview and the scope of the claims appended hereto.

What is claimed is:

1. A wire-containing knit fabric anti-vandalism layer, said knit fabric anti-vandalism layer comprising cut-resistant fibers, wherein at least one thread system of said knit fabric contains a wire; wherein said wire is present in at least one thread system projecting from the surface of the knit fabric; and wherein said wire-containing thread system projects from the surface of the knit fabric in a manner such that during subsequent gluing of the anti-vandalism layer to an exterior layer the gluing occurs on the projecting wire-containing thread system.

2. The anti-vandalism layer in accordance with claim 1, wherein said cut-resistant fibers comprise aramid fibers, polyethylene fibers produced using a gel-spinning process, or glass fibers.

3. The anti-vandalism layer in accordance with claim 1, wherein said knit fabric is a warp knit fabric.

4. The anti-vandalism layer in accordance with claim 1, wherein said knit fabric is a Raschel fabric.

5. The anti-vandalism layer in accordance with claim 1, wherein said knit fabric is a crochet galloon fabric.

6. The anti-vandalism layer in accordance with claim 1, wherein said wire present in at least one thread system has a diameter of from 0.1 to 2.0 mm.

7. The anti-vandalism layer in accordance with claim 1, wherein said wire present in at least one thread system has a diameter of from 0.2 to 0.6 mm.

8. The anti-vandalism layer in accordance with claim 1, wherein said wire present in at least one thread system has a corrugated or spiral shape.

9. The anti-vandalism layer in accordance with claim 1, wherein said wire present in at least one thread system is sheathed in a knit fabric made from textile yarn.

10. The anti-vandalism layer in accordance with claim 1, wherein said wire present in at least one thread system is enveloped by a readily fusible polymer.

11. The anti-vandalism layer in accordance with claim 1, wherein said wire present in at least one thread system is enveloped by a readily fusible polymer and sheathed in a knit fabric made from textile yarn.

12. A vehicle seat comprising the anti-vandalism layer in accordance with claim 1.

13. A sliding roof for motor vehicles or a convertible top comprising the anti-vandalism layer in accordance with claim 1.

14. A protective layer under a tarpaulin for trucks or other commercial transport vehicles comprising the anti-vandalism layer in accordance with claim 1.

15. A protective layer under a woven fabric or other flat structure for tents or inflatable structures comprising the anti-vandalism layer in accordance with claim 1.

16. A protective layer under an exterior layer in wall facing such as impact pads or in similar wall, floor, or ceiling protective facing comprising the anti-vandalism layer in accordance with claim 1.

17. The vehicle seat in accordance with claim 12, wherein said anti-vandalism layer is under an exterior material and said exterior material is glued to said anti-vandalism layer at said wire-containing thread system projecting from the surface of the knit fabric.

18. A tarpaulin for trucks or other commercial transport vehicles, wherein said tarpaulin contains, under the actual tarpaulin layer made from woven fabric or another flat structure, at least one anti-vandalism layer in accordance with claim 1.

19. An impact pad for sports facilities or public transportation, or protective facing of ceilings, walls, or floors, wherein said impact pad or said protective facing contains, under the exterior layer, at least one anti-vandalism layer in accordance with claim 1.

20. The anti-vandalism layer in accordance with claim 1, wherein said fabric weight per unit area is from 100 to 2,000 g/m$^2$.

21. The anti-vandalism layer in accordance with claim 1, wherein said gluing is linewise.

* * * * *

UNITED STATES PATENT AND TRADEMARK OFFICE

CERTIFICATE OF CORRECTION

PATENT NO. : 5,545,470

DATED : August 13, 1996

INVENTOR(S) : Dieter H. P. Schuster, et al.

It is certified that error appears in the above-indentified patent and that said Letters Patent is hereby corrected as shown below:

In Column 4, Line 15, change " SYMBOL 210 /f "Symbol" to "®" or "registered trademark".

In Column 9, Line 60 to Column 10, Line 11, Table showing Examples 2-4 should appear as follows:

| | Example 2 | Example 3 | Example 4 |
|---|---|---|---|
| Short guide bar Aramid Yarn Titer (dtex) | 1,100 | 1,680 | 1,680 |
| Figuring guide bar 1 Aramid yarn Titer (dtex) | 1,680 | 3,360 | 3,360 |
| Figuring guide bar 2 Wire (mm) | 0.6 | 0.3 | 0.6 |
| Aramid yarn for knit sheathing Titer (dtex) | 840 | 1,680 | 1,680 |
| Weight per unit area ($g/m^2$) | 765 | 415 | 885 |

UNITED STATES PATENT AND TRADEMARK OFFICE

CERTIFICATE OF CORRECTION

PATENT NO. : 5,545,470

DATED : August 13, 1996

INVENTOR(S) : Dieter H. P. Schuster, et al.

It is certified that error appears in the above-indentified patent and that said Letters Patent is hereby corrected as shown below:

In Column 10, Line 48, Table Showing Examples 6-8 should appear as follows:

| | Example 6 | Example 7 | Example 8 |
|---|---|---|---|
| Short guide bar | | | |
| Aramid yarn | | | |
| Titer (dtex) | 1,100 | 1,680 | 1,680 |
| Figuring guide bar 1 | | | |
| Aramid yarn | | | |
| Titer (dtex) | 1,680 | 3,360 | 3,360 |
| Figuring guide bar 2 | | | |
| Aramid yarn | | | |
| Titer (dtex) | 3,360 | 3,360 | 3,360 |
| Figuring guide bar 3 | | | |
| Wire (mm) | 0.3 | 0.3 | 0.6 |
| Aramid yarn for knit sheathing | | | |
| Titer (dtex) | 1,680 | 1,680 | 1,680 |
| Weight per unit area ($g/m^2$) | 471 | 506 | 977 |

UNITED STATES PATENT AND TRADEMARK OFFICE

CERTIFICATE OF CORRECTION

PATENT NO. : 5,545,470
DATED : August 13, 1996
INVENTOR(S) : Dieter H. P. Schuster, et al.

It is certified that error appears in the above-indentified patent and that said Letters Patent is hereby corrected as shown below:

In Column 11, Line 33 to Line 49, table showing Examples 10 and 11 should appear as follows:

| | Example 10 | Example 11 |
|---|---|---|
| Short guide bar | | |
| Aramid yarn | | |
| Titer (dtex) | 1,100 | 1,680 |
| Figuring guide bar 1 | | |
| Aramid yarn | | |
| Titer (dtex) | 1,680 | 3,360 |
| Figuring guide bar 2 | | |
| Wire (mm) | 0.3 | 0.3 |
| Aramid yarn | | |
| Titer (dtex) | 1,100 | 1,680 |
| Figuring guide bar 3 | | |
| Wire (mm) | 0.6 | 0.3 |
| Aramid yarn for knit sheathing | | |
| Titer (dtex) | 840 | 1,680 |

UNITED STATES PATENT AND TRADEMARK OFFICE

CERTIFICATE OF CORRECTION

PATENT NO. : 5,545,470

DATED : August 13, 1996

INVENTOR(S) : Dieter H.P. Schuster, et al.

It is certified that error appears in the above-indentified patent and that said Letters Patent is hereby corrected as shown below:

| | | |
|---|---|---|
| Weight per unit area ($g/m^2$) | 877 | 554 |

Signed and Sealed this

Thirteenth Day of May, 1997

*Attest:*

BRUCE LEHMAN

*Attesting Officer*

*Commissioner of Patents and Trademarks*